United States Patent [19]

Gloor

[11] 4,356,862

[45] Nov. 2, 1982

[54] METHOD FOR CHANGING THE DIMENSIONS OF A STRAND DURING CONTINUOUS CASTING

[75] Inventor: Hans Gloor, Umiken, Switzerland

[73] Assignee: Concast AG, Zurich, Switzerland

[21] Appl. No.: 194,002

[22] Filed: Oct. 6, 1980

[30] Foreign Application Priority Data

Nov. 2, 1979 [CH] Switzerland ..... 9836/79

[51] Int. Cl.[3] ..... B22D 11/04

[52] U.S. Cl. ..... 164/491; 164/436

[58] Field of Search ..... 164/452, 491, 435, 436, 164/154

[56] References Cited

U.S. PATENT DOCUMENTS 3,838,730 10/1974 Nagaoka et al. ..... 164/436 X
3,886,991 6/1975 Meier et al. ..... 164/414 X
3,926,244 12/1975 Meier et al. ..... 164/491 X
4,010,793 3/1977 Takemura et al. ..... 164/436 X

FOREIGN PATENT DOCUMENTS 50-152926 12/1975 Japan .
54-128939 10/1979 Japan ..... 164/436

*Primary Examiner*—Gus T. Hampilos
*Assistant Examiner*—K. Y. Lin
*Attorney, Agent, or Firm*—Werner W. Kleeman

[57] ABSTRACT

To obtain a short adjustment time with small risk of metal break-out, it is intended during the changing of the dimensions of a continuously cast strand to alter during the casting operation i.e. while the pour or teeming operation is in progress, at least during a time interval of the pivotal movement of the mold wall, the mutual relationship of the displacement speeds of two devices for moving the mold wall and the position of the pivot axis of the mold wall is shifted parallel to its starting position.

7 Claims, 4 Drawing Figures

METHOD FOR CHANGING THE DIMENSIONS OF A STRAND DURING CONTINUOUS CASTING

CROSS REFERENCE TO RELATED CASE

This application is related to the commonly assigned U.S. application Ser. No. 176,706, filed Aug. 11, 1980, entitled "Method of Adjusting the Setting Speed of the Narrow Sides of plate Molds", now U.S. Pat. No. 4,304,290, granted Dec. 8, 1981.

BACKGROUND OF THE INVENTION

The present invention relates to a new and improved method for altering the dimensions of a cast strand or casting during continuous casting operations, while the pour or teeming operation is in progress, wherein at least one movable mold wall is moved by means of two displacement devices arranged in tandom in the direction of strand travel, about a pivot axis extending transversely with respect to the lengthwise axis of the strand and parallel to the mold wall and transverse to the strand lengthwise axis. The invention also relates to novel apparatus for the performance of the aforementioned method.

During the continuous casting of strands, especially during the continuous casting of steel, there is already known in this technology to employ plate molds having movable walls for changing the taper of the hollow mold compartment between the narrow sides of the mold during such time as the continuous casting operation is in progress, i.e. during the pouring or teeming operation.

There is also known to the art a method for increasing the dimensions of a continuously cast strand, during the continuous casting operation, i.e. without interrupting the infeed of steel. Here, at least one of both movable transverse walls or short sides of plate molds are moved by means of two spindles arranged in tandem or behind one another in the direction of strand travel. The narrow or short side of the mold is pivoted during a first step, thereafter during a second step is shifted parallel to itself transversely with respect to the lengthwise axis of the continuously cast strand, and during a third step is again pivoted back into a position corresponding to the desired casting taper. During the first step the narrow side is moved about a pivot axis which coincides with the outlet edge of the narrow side of the continuous casting mold. During the third step the pivot axis is located at the region of the bath level or meniscus or coincides with the inlet edge of the narrow side of the continuous casting mold.

However, there is also known to the art a method wherein while the casting or teeming operation is in progress, the width of a slab casting is decreased. Also with this method there are carried out the three aforementioned steps, to wit, pivoting, parallel displacement, pivoting back of the narrow or short side of the mold.

With the heretofore known methods there are formed during the pivotal movement air gaps between the strand shell or skin and the mold wall and/or impermissible deformations at the still thin strand shell with the corresponding friction and mold wear. These conditions therefore require extremely low pivoting speeds of the mold wall if the risk of metal break-out is to be maintained small. Small pivoting speeds result in small adjustment speeds and, apart from a low casting output, additionally produce long, conical transition pieces between the old strand format or sectional shape and the new strand format. These are undesired because they require correction by flame cutting operations or the like.

SUMMARY OF THE INVENTION

Therefore, with the foregoing in mind it is a primary object of the present invention to provide a new and improved method of, and apparatus for, enabling altering of the dimensions of a strand during a continuous casting operation, in a manner not associated with the aforementioned drawbacks and limitations of the prior art proposals.

Another and more specific object of the present invention aims at providing a new and improved method and apparatus of the previously mentioned type, which enables overcoming the heretofore discussed shortcomings, while affording shorter adjustment times and short transition pieces at the casting and rendering possible the production of greater differences in the sectional shape or format of the casting without increasing the danger of metal break-out.

Another important object of the present invention aims at maintaining small the mold wear caused by friction between the strand shell and the mold wall.

Now in order to implement these and still further objects of the invention which will become more readily apparent as the description proceeds, the invention contemplates that at least during one time interval of the pivotal movement of the mold wall there is altered the mutual relationship of the adjustment or displacement of both displacement devices and the position of the pivot axis is displaced parallel to its starting position.

As already indicated above, the invention is not only concerned with the aforementioned method aspects, but also pertains to novel apparatus for the performance of such method, which apparatus is manifested by the features that each of both displacement or movement devices is provided with a control for adjusting the displacement speed, and such control is operatively connected with a programmable computer.

When employing the inventive method it is possible to maintain, during the pivotal movement, both the formed air gap between the strand shell and the mold wall at a minimum as well as also deformations of the strand shell caused by the mold wall. There are obtained values for changes of the strand width by deformation and air gaps at molds with 600 mm useful length of, for instance 0.5 mm. The casting speed can be maintained at a high value. The obtainable high pivoting speed enables setting large pivot angles during a short time interval. During the subsequent parallel displacement of the mold wall, the large pivot angle enables attaining a high displacement speed of the movable mold wall transverse to the lengthwise axis of the continuously cast strand. Hence, there are realized short adjustment times and short transition pieces. Moreover, the metal break-out risk and the risk of wear to the mold can be maintained comparable to average values as are known for the continuous casting art.

It is possible to carry out within the teachings of the invention many different variations of the movement or displacement characteristic of both displacement devices with respect to acceleration and deceleration. A particularly advantageous ratio or relationship of the displacement speed of both displacement devices relative to one another for pivoting-back the movable mold wall, prior to completion of an enlargement of the hollow mold compartment, contemplates moving the displacement device which is closer to the infeed side of the casting mold, during the pivoting-back movement of the mold wall, starting with the pivoting-back movement, at a linearly decreasing speed, whereas the displacement device which is closer to the outlet of the mold, during the start of the pivoting-back movement, initially is moved at a constant speed during a first time interval of the pivoting-back time and during a second time interval of the pivoting-back time such displacement device is moved at a linearly decreasing speed or velocity.

Additional improvements as concerns reduction in the air gap and/or reduction of the deformation of the strand shell can be obtained if at least the displacement speed of a displacement or setting device for the mold wall is altered during the pivotal movement in accordance with a transition curve of a higher order.

However, in certain cases it also can be advantageous if at least the displacement speed of a displacement device is moved during the displacement movement with a discontinuous velocity or speed change. Hence, the discontinuous displacement speed change can be coupled, for instance with the mold oscillation or with further casting parameters, such as withdrawal force of the strand, friction between the strand and the mold, heat transfer between the strand at the moved mold wall, adjustment force measured at the drive of the displacement device and so forth.

As a further advantageous solution it is recommended, according to the invention, the superimpose the pivotal movement with a displacement movement of the mold wall which is directed approximately transversely with respect to the direction of strand travel. During the entire displacement movement the mold wall also can carry out pivotal movements transverse to the strand lengthwise axis during the known phase of parallel displacement of the mold wall, wherein the position of the pivot axis can be continuously shifted.

The displacement or setting devices can be provided, for instance, with controls which in accordance with a predetermined program control the displacement or shifting speeds. Such program does not take into account any control magnitudes of a casting parameter. According to a further feature of the invention it is particularly advantageous if the control is connected with a regulation device or regulator and such regulation device utilizes as the control magnitude at least one casting parameter input, such as friction between the strand and the mold, cooling capacity of the moved mold wall, adjustment force measured at the drive of the displacement devices, gap size between the moved mold wall and the strand and so forth.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
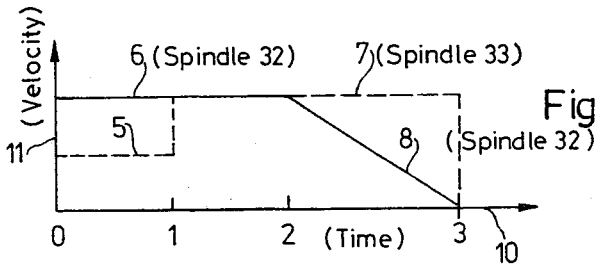
FIGS. 1, 2 and 3 respectively illustrate velocity-time diagrams of different exemplary embodiments of the method for changing the dimensions of a strand during the time that the continuous casting operation is in progress.

Describing now the drawings, it is to be understood that only enough of the construction of the continuous casting installation has been conveniently shown in the drawings to simplify the illustration, as is needed for one skilled in the art to readily understand the underlying principles and concepts of the invention. Turning attention now to FIG. 1 in the velocity-time diagram illustrated therein there has been plotted along the abscissa 10 the time and along the ordinate 11 the displacement velocity or speed. The three method steps which are undertaken, during changing the dimensions of a continuously cast strand during such time as the casting operation is in progress, i.e. during the pouring or teeming operation, can be described as follows: Between null and 1 there is pivoted at least one of the movable mold walls, such as the mold wall 30 of FIG. 4, by means of two displacement devices, for instance in the form of spindles as indicated by reference characters 32 and 33 in FIG. 4. These displacement or mold wall-shifting devices 32 and 33 are arranged in tandem in the direction of strand travel as indicated generally by the arrow 31. In most instances two mold walls are simultaneously adjusted. With the method as contemplated in accordance with FIG. 1 the displacement speed 5 of the spindle, such as the spindle 33 closer to the outlet or exit side of the mold, is smaller than the displacement speed 6 of the spindle, such as the spindle 32, situated closer to the mold inlet side. The pivot axis, during such pivotal movement, frequently is placed at the outlet-side edge of the mold wall. Between the time interval represented by reference characters 1 and 2 there is carried out the second method step, which is constituted by a parallel displacement of the mold wall. Both of the spindles possess the same adjustment or setting speed. During the parallel displacement of the mold wall it is possible to additionally superimpose the casting taper correction which is accommodated to the change in strand width. The third method step, which encompasses the pivoting-back of the mold wall is accomplished within the time span represented by reference characters 2 and 3. The spindle situated closer to the mold outlet side, during the pivoting back movement, moves at a constant speed or velocity, whereas the other spindle, within this time interval or span, moves with a linearly decreasing speed or velocity 8. Thus, during the entire time interval of the pivoting-back movement of the mold wall the mutual relationship or ratio of the displacement speeds of both spindles alters. Additionally, also the position of the pivot axis is continuously shifted during the entire time interval.

Figure 2:
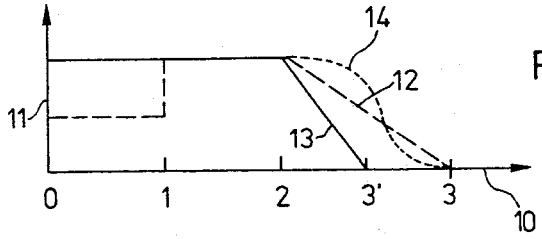

Now in FIG. 2 there has been illustrated a further velocity-time diagram representing a different pivoting-back characteristic. The course of the movement during the first and second time intervals is unchanged in relation to the corresponding time intervals of FIG. 1. Here however in the third time interval or span represented by reference characters 2 and 3, both of the spindles move in accordance with the lines 12 and 13, during the return or pivot-back movement, at different linearly decreasing velocities. The spindle closest to the mold outlet side thus comes to standstill at the time 3', whereas the other spindle continues to move with continuously decreasing speed 12 up to the time 3. As a further variant to the movement represented by the line 12 it would be possible to have a pivot speed 14 of the mold wall, during the pivot-back movement, represented by a curve 14 of higher order. Depending upon the position and the characteristic of the curve it is possible to alter the relationship of the air gap/deformation of the strand shell or skin and to accordingly optimize the casting parameters.

Figure 3:
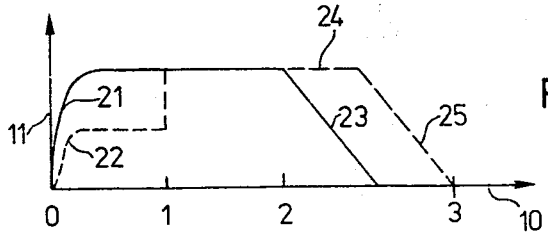

Continuing, in FIG. 3 there also has been illustrated in the first time section or span, during the initial pivotal movement of the related mold wall, the transition curves 21 and 22 for the velocity increase. In the third time span or interval 2–3 the displacement device closer to the mold inlet side is moved with a linear decreasing speed or velocity as represented by the line 23 during the pivoting-back movement beginning with the start of such pivot-back movement, whereas the other displacement device, at the start of the pivoting-back movement, initially is moved with a constant speed or velocity 24 during a first portion of the pivoting-back time and during a second part of such pivoting-back time it is moved with linearly decreasing velocity or speed 25. This pivot-back characteristic, with a mold having 600 mm useful length, resulted in a pouring speed of 1 meters/minute and a total time for the three method steps of 2.5 minutes for a displacement path of 50 mm with a disturbance-free change in the strand dimensions. As a rule, it is advantageous in the case of plate molds to simultaneously move both narrow or small sides of the mold. According to the described velocity courses the displacement velocity can also discontinuously change, for instance in a step-like configuration, during the displacement or movement of the mold wall.

Figure 4:
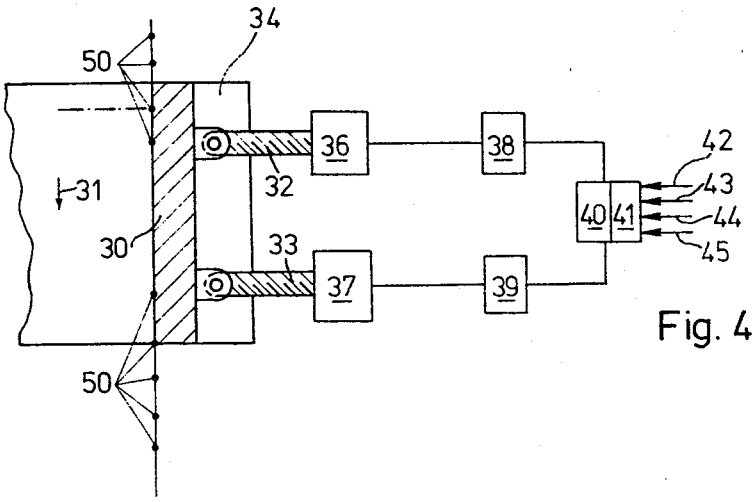
FIG. 4 is a fragmentary sectional view through a partially illustrated plate mold and the related adjustment and control devices.
Figure 1:
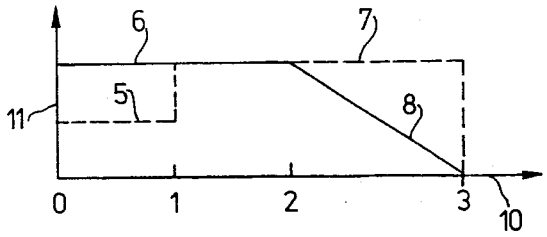
Figure 2:
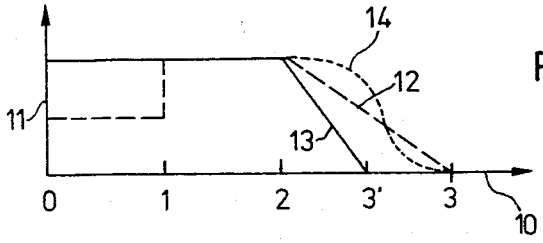
Figure 3:
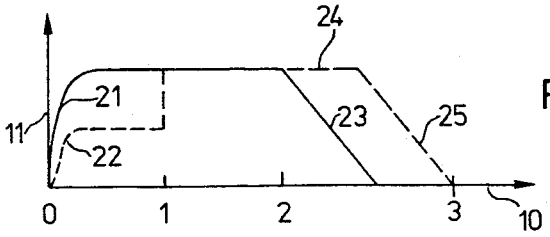
Figure 4:
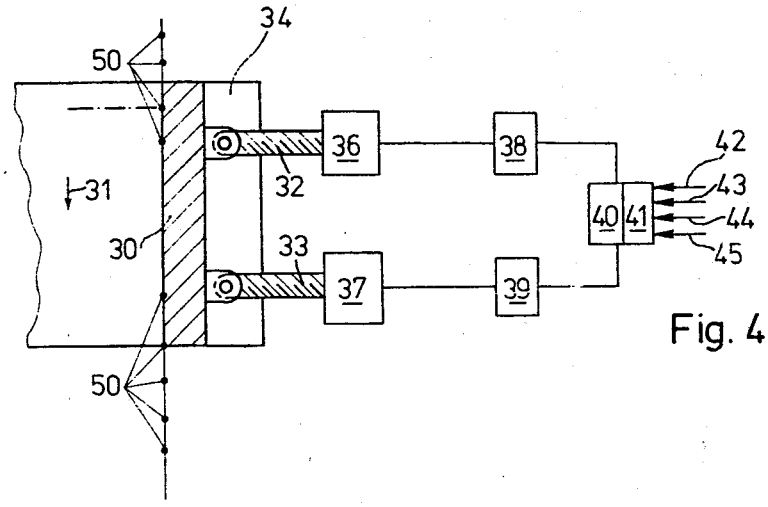

Turning attention now to FIG. 4, there will be recognized that two tandemly arranged displacement devices 32 and 33 for changing the format of the cast strand, are hingedly connected at a transverse wall or short side 30 of a plate mold. This transverse wall or short side 30 of the plate mold is adjustably arranged between two longitudinal walls or wide side walls 34 of the mold. The displacement devices 32 and 33 are arranged in succession, viewed with respect to the strand direction of travel 31, and such displacement devices 32 and 33 may be constituted, as illustrated, by conventional spindles as is well known in this art. The displacement device 32 is situated closer to the mold inlet side and the displacement device 33 is situated to the mold outlet or exit side. These displacement devices 32 and 33 are provided with conventional spindle drives 36 and 37, which, in turn, are equipped with suitable controls or control devices 38 and 39 for setting the desired displacement speeds. The predetermined displacement speeds of both independently driven displacement devices 32 and 33 is controlled by means of a programmable computer 40. Apart from this pre-programmable control the computer 40 can also be provided with a regulation device or regulator 41 which evaluates as the control magnitude for the computer program at least one of the casting parameter inputs, such as friction value 42 between the strand and the mold, cooling capacity 43 of the moved mold wall, displacement force 44 measured at the drive of the displacement devices and/or gap size 45 between the moved mold wall and the strand. Instead of using the threaded spindles 32 and 33 it also would be possible to employ other displacement devices, such as displacement path-controlled hydraulic cylinders and the like.

During the displacement and pivot-back movement the movable mold wall is moved about a pivot axis extending transversely with respect to the strand lengthwise axis and parallel to the mold wall. As to the movements of the mold wall described above in accordance with FIGS. 1, 2 and 3, respectively, it is to be understood that at least during one time interval of the pivot-back movement the position of the imaginary pivot axis 50 is shifted parallel to its starting position. There are conceivable pivot axes 50 which coincide with the boundary surface of the hollow mold compartment of the movable mold wall 30 or which are located externally of the mold wall.

The method of changing the dimensions of a continuously cast strand is useful both for enlarging as well as reducing the strand format or sectional shape.

While there are shown and described present preferred embodiments of the invention, it is to be distinctly understood that the invention is not limited thereto, but may be otherwise variously embodied and practiced within the scope of the following claims. Accordingly,

What I claim is:

1. A method of changing the dimensions of a continuously cast strand during the continuous casting operation while a pour is in progress, comprising the steps of:

providing for at least one movable mold wall two mold wall-displacement devices arranged behind one another with respect to the direction of travel of the continuously cast strand;

moving said at least one movable mold wall by means of said two displacement devices about a pivot axis extending transversely with respect to the lengthwise axis of the cast strand and parallel to the mold wall;

at least during a time span of the pivotal movement of the mold wall altering the mutual relationship of the displacement speeds of both displacement devices;

shifting the position of the pivot axis essentially parallel to its starting position; and prior to termination of the changing of the dimension of the strand pivoting the mold wall into a position corresponding to the desired casting taper.

2. The method as defined in claim 1, wherein:

one of both displacement devices is moved, during the pivotal movement, at an essentially constant speed and the other displacement device is moved, during the pivotal movement, with a linearly altering speed.

3. The method as defined in claim 1, wherein:

both of the displacement devices are moved, during the pivotal movement, with different linearly altering speeds.

4. The method as defined in claim 1, wherein:

one of the displacement devices is situated closer to a mold inlet side and the other displacement device is situated closer to a mold outlet side; and the displacement device situated closer to the mold inlet side is moved, during the pivot-back movement at the start of such pivot-back movement, with a linearly decreasing speed, whereas the displacement device situated closest to the mold outlet side is moved at the start of the pivot-back movement initially at a constant speed during a first time span of the pivot-back time and is moved with a linearly decreasing speed during a second time span of the pivot-back time.

5. The method as defined in claim 1, wherein:

at least the displacement speed of one of the displacement devices is varied during the pivotal movement in accordance with a transition curve of a higher order.

6. The method as defined in claim 1, wherein:

at least the displacement speed of one of the displacement devices is moved, during the pivotal movement, with a discontinuous change in speed.

7. The method as defined in claim 1, wherein:

the pivotal movement is carried out to superimpose on a displacement movement of the mold wall directed approximately transversely with respect to the strand direction of travel.

* * * * *